United States Patent [19]

Honjo et al.

[11] 3,941,594

[45] Mar. 2, 1976

[54] ELECTROPHOTOGRAPHIC ELEMENT WITH ZNO AND $TIO_2$

[75] Inventors: Satoru Honjo, Tokyo; Hajime Miyatuka, Asaka, both of Japan

[73] Assignee: Rank Xerox Ltd., London, England

[22] Filed: July 25, 1973

[21] Appl. No.: 382,437

Related U.S. Application Data

[63] Continuation of Ser. No. 178,223, Sept. 7, 1971, abandoned.

[30] Foreign Application Priority Data

Sept. 9, 1970 Japan ..... 45-79021

[52] U.S. Cl. ..... 96/1.8; 96/1.5; 252/501

[51] Int. Cl.[2] ..... G03G 5/08

[58] Field of Search ..... 96/1.5, 1.8; 252/501

[56] References Cited

UNITED STATES PATENTS

| | | | |
|---|---|---|---|
| 3,212,890 | 10/1965 | Kimble et al. | 96/1.3 |
| 3,220,830 | 11/1965 | Kashiwabara | 96/1.8 |
| 3,471,288 | 10/1969 | Berman | 96/1 R |
| 3,569,803 | 8/1968 | Sato et al. | 96/1.8 |
| 3,595,649 | 7/1971 | Shimizu et al. | 96/1.8 X |
| 3,653,895 | 4/1972 | Brandon | 96/1.8 X |
| 3,706,560 | 12/1972 | Grain | 96/1.8 X |

FOREIGN PATENTS OR APPLICATIONS

| | | | |
|---|---|---|---|
| 1,009,379 | 11/1965 | United Kingdom | 96/1.5 |

*Primary Examiner*—Roland E. Martin, Jr.
*Attorney, Agent, or Firm*—James R. Ralabate; James P. O'Sullivan; John E. Crowe

[57] ABSTRACT

A photosensitive member for electrophotographic use having a photosensitive binder layer comprising zinc oxide and titanium dioxide photoconductive particles blended in a ratio of about 50:50 to 80:20 by weight and homogeneously dispersed into a film forming insulating resin binder, the particles having an average size of about 0.05 micron to 1.0 micron and the zinc oxide and titanium dioxide particles diffusing in light sensitivity by a factor of more than about 1.2 based on a gray filtered mean daylight source.

5 Claims, 1 Drawing Figure

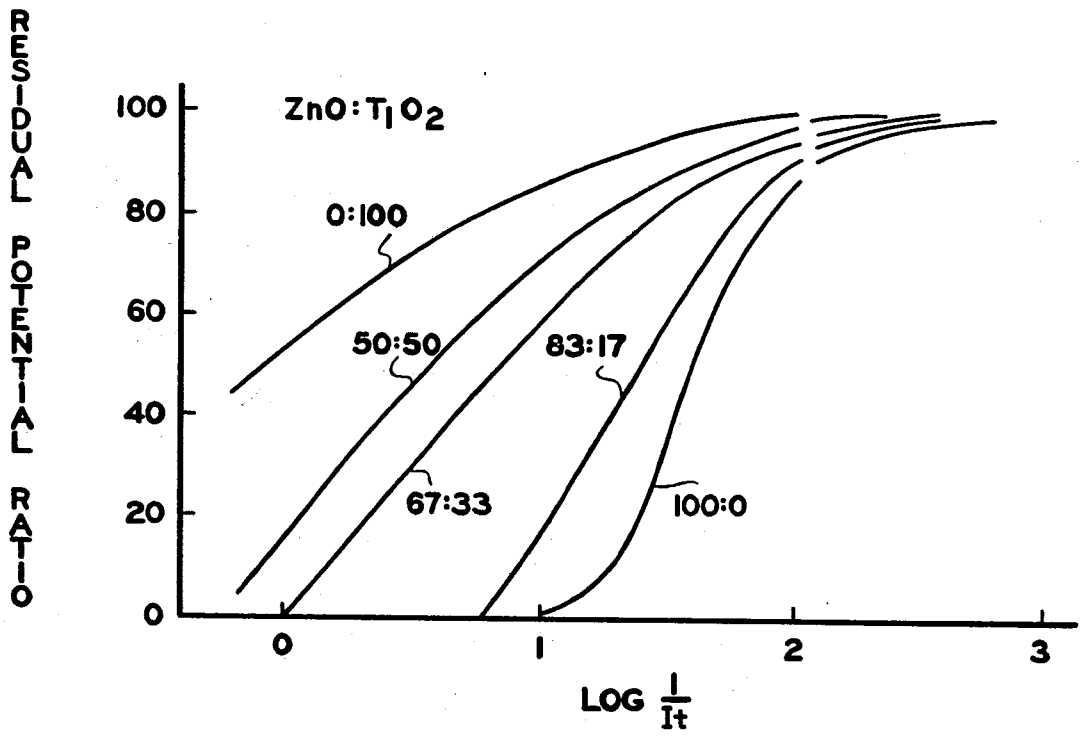
ZnO:TiO2
0:100
50:50
67:33
83:17
100:0
100
80
60
40
20
0
0
1
2
3
LOG 1/It
RELATIVE POTENTIAL RATIO

ELECTROPHOTOGRAPHIC ELEMENT WITH ZnO AND $TiO_2$

This is a continuation of application Ser. No. 178,223, filed Sept. 7, 1971, now abandoned and relates to a method for obtaining photoreceptor members suitable for continuous tone reproduction.

BACKGROUND OF THE INVENTION

In the art of xerography, a photosensitive member comprising a binder layer, such as zinc oxide particles dispersed in a film forming insulating resin, is uniformly electrostatically charged in the dark and then exposed to a pattern of activating radiation to form a latent electrostatic image on the surface of the binder layer. This latent image may then be developed by immersing the photosensitive member in a liquid developing solution which contains toner particles. The toner particles are attracted to and adhere to the areas containing the latent electrostatic image. After removal from the developer bath, the photosensitive member is dried and the image fused to form a permanent reproduction of the original radiation pattern or image.

It is well known in the art of electrophotography that it is difficult to adjust the properties of a photosensitive layer to render it suitable for continuous tone reproduction where the photosensitive layer is imaged in the conventional sequence of charging, exposure, and development with toner. In the art of photography, there are available grades designated No. 1 to No. 5 of printing paper of silver salt photography having the characteristic curve for soft to hard tones. In electrophotography, however, the conventional photoconductor member is characterized by a straight line in that the characteristic curve is shorter and the incline of the curve usually larger, which means harder. This characteristic curve is prepared by plotting the logarithm of the exposure strength at the abscissa and relative residual potential or developer concentration at the ordinate.

Where a photosensitive layer contains photoconductive particles dispersed in an insulating resin binder, it is known that the incline of the characteristic curve cannot be largely adjusted, even by changing the ratio of the binder and photoconductive member, or by other process variations in the preparation of the binder layer.

In order to avoid the above problems, the art has adapted various process techniques. One of these comprises a photosensitive layer which is prepared by kneading photosensitive zinc oxide sensitized with pigment absorption, and unsensitized zinc oxide with a binder. This process is more fully described in Japanese Patent Publication No. 11710/1966. U.S. Pat. No. 3,003,870 teaches the use of two kinds of zinc oxide having different sensitivities which are included in a continuous layer. British Pat. No. 967,690 teaches the use of several distinct binder layers sensitized by pigments having different sensitivities.

It can be seen from the above prior art, that complicated manufacturing processes, requiring much labor and resulting in lower efficiency in production, are required in order to obtain photoconductors exhibiting a soft characteristic suitable for continuous tone reproduction.

Conventional electrophotography is usually used for obtaining a positive image from a positive original. It is well known, however, that positive members usually have rather hard tone. Accordingly, by the use of conventional techniques described above, it is difficult to prepare photoreceptors exhibiting tone soft enough to meet requirements for a continuous tone reproduction.

OBJECTS OF THE INVENTION

It is, therefore, an object of this invention to provide a novel photoreceptor member which overcomes the above noted disadvantages.

It is another object of this invention to provide a photosensitive layer having a soft characteristic suitable for continuous tone reproduction.

It is a further object of this invention to provide a photoreceptor binder member which exhibits excellent whiteness.

It is yet another object of this invention to provide a photoreceptor member which exhibits a characteristic curve having a long straight line suggestive of soft characteristics.

SUMMARY OF THE INVENTION

The foregoing objects and others are accomplished in accordance with this invention by providing a novel xerographic binder layer which comprises a mixture of photoconductive zinc oxide and titanium dioxide particles contained in a film forming insulating resin. More specifically, the photosensitive binder layer of this invention comprises a mix of photoconductive zinc oxide and a photoconductive titanium dioxide in a weight ratio of zinc oxide to titanium dioxide of about 50:50 to 80:20. The average particle size of each component should be controlled from about 0.05 microns to 1.0 microns, with the difference in sensitivity between the components being more than about 1.2. The two photoconductive components are homogeneously dispersed in an insulating film forming resin binder.

BRIEF DESCRIPTION OF THE DRAWING

The FIGURE in the drawing is a graph representing the residual potential ratio plotted against Log I/It for photosensitive layers of this invention as compared to conventional photosensitive layers.

DETAILED DESCRIPTION OF THE INVENTION

The photoconductive composition of the instant invention comprises a photosensitive binder layer in which photosensitive zinc oxide and titanium dioxide particles are dispersed in a film forming insulating resin. More specifically, rutile titanium dioxide is preferred for use. As stated above, the ratio of the zinc oxide to titanium dioxide should be from about 50:50 to 80:20 by weight.

The tone of the photosensitive binder layer of this invention becomes softer following an increase in the titanium dioxide blending ratio. Consequently, when the zinc oxide blending ratio exceeds 80:20, the tone is extremely hard, and the purpose of the present invention cannot be realized. The maximum ratio of zinc oxide to titanium dioxide is therefore 80:20 by weight. The difference in sensitivity between the zinc oxide and titanium dioxide has some influence on the tone. For example, when the difference is too small, the tone is not significantly different from that obtained from zinc oxide alone.

Titanium dioxide when used alone for a photosensitive binder layer, has a very low sensitivity and also has a lower charging potential and weak charging power. Accordingly, a photosensitive binder layer which would be prepared with titanium dioxide alone requires a longer time for exposure and yields a very low concentration of the developed picture. Thus, the photosensitive layer titanium dioxide alone is not completely satisfactory for use in xerography.

When the amount of titanium dioxide to be used in the instant invention exceeds a given level, the tone becomes soft. It has, therefore, been established that the maximum blending ratio of titanium dioxide to zinc oxide is about 50:50 by weight.

In forming photoconductive binder layers of the instant invention, the two photoconductive compounds are kneaded or mixed together with a binder and usually a binder solvent, to prepare a coating solution for the photosensitive layer. This solution or binder mixture is then coated onto a supporting substrate and allowed to dry, resulting in a final photoconductive layer. The degree of kneading depends upon the resulting power and smoothness required for the final image which is to be produced. It is important, however, to knead sufficiently to produce a very smooth coating surface for continuous tone reproduction. For obtaining an image picture of good continuous tone reproducability, the surface of the photosensitive layer should be particularly uniforming and smooth. It is important to keep photoconductor particle masses no larger than 10 microns in order that they not be seen on the photosensitive layer.

The dispersing property characteristic of titanium dioxide is far lower than that of zinc oxide. Therefore, the titanium dioxide particles should be kneaded to disperse sufficiently for producing a photosensitive layer which can satisfy the above described requirements. Usually sufficient dispersion is obtained by kneading in a ball mill for about 24 hours.

In general, any film forming insulating organic resin may be suitable for use in the instant invention. The typical resins include: vinyl, chloride-vinyl acetate copolymers, thermosetting acrylic resins, epoxy-esters of fatty acids of vegetable oils, styrenated akyl resin, and acrylic-ester resins. The weight ratio of the photoconductive powder mixture to the insulating binder is preferably in the range of about 25:1 to 6:1. The photosensitive layer of this invention has utility as a photosensitive member for use in electrophotography by placing the binder layer on a conventional substrate such as a metal, plastic film or paper. In general the form of the photosensitive member may comprise any shape such as a sheet, plate, cylinder, or web.

DESCRIPTION OF THE PREFERRED EMBODIMENTS

The following example further specifically defines the present invention with respect to a method of making a photoreceptor binder layer having a soft characteristic suitable for a continuous tone reproduction. The percentages in the specifications, examples and claims are by weight unless otherwise indicated. The example below is intended to illustrate various preferred embodiments of the instant invention.

EXAMPLES

A mixture of photoconductive particles of zinc oxide and titanium dioxide are kneaded with a vinyl chloride-vinyl acetate copolymer in a porcelain ball mill using n-butal acetate as a solvent. The weight ratio of the whole photoconductive mixture versus the copolymer is adjusted to 10:3 by weight. The resulting mixture is then used as a coating solution. The coating solution is applied to an aluminum foil substrate to obtain a dry film thickness of 5 to 6 microns, and the solvent completely evaporated to form the dry coating. A total of 5 photosensitive members having 100, 83, 67, 50 and 0 percent zinc oxide, respectively, with the balance titanium dioxide, are made by the technique described above. The photosensitive binder members are allowed to stand in the dark for two days for dark adaptation, and then charged with negative corona and the dark attenuation observed. The initial potential and the residual potential ratio (the value obtained by measuring the potential 60 seconds after observing the initial potential in the dark and dividing the obtained value by initial potential, followed by multipling by 100) are shown in the following table.

Table

| Blending ratio by weight ZnO | $TiO_2$ | Initial potential (volt) | Residual potential ratio (%) |
|---|---|---|---|
| 100 | 0 | −235 | 92 |
| 83 | 17 | −208 | 90 |
| 67 | 33 | −188 | 88 |
| 50 | 50 | −170 | 84 |
| 0 | 100 | − 70 | 60 |

From the table it can be seen that the initial potential is low for 100 percent titanium dioxide and residual potential ratio high for the 100 percent zinc oxide layer.

Other specimens are taken from the products produced in the above example and exposed to lights having different illumination prepared by combining gray filters to a C light source (C light source represents the mean daylight). The light attenuation was determined by this method. The residual potential ratio was calculated by the following formula:

$$\frac{V_L/V_0}{V_D/V_0} \times 100\ (\%)$$

wherein $V_L$ = a potential after a given exposing time, t sec., with an illuminance, 1.

$V_0$ = a potential before exposure $V_0^1$ = an initial potential when observing dark attenuation $V_D$ = a potential t seconds after dark attenuation The residual potential as plotted in the ordinate and in the value of log l/It was plotted on the abscissa, and a characteristic curve obtained. The specimens were observed at 18°C with 63 percent relative humidity. The results are shown in the figure of the drawing. The parameter for the curves is the weight ratio of ZnO:-$TiO_2$. According to these curves, the specimen having the larger amounts of titanium dioxide showed a soft but low sensitivity, and the specimen of zinc oxide alone showed a hard characteristic. The specimen including mixtures falling within the scope of the instant invention showed preferable properties having a longer straight line. This preferable range for ZnO:$TiO_2$ is 50:50 to 80:20.

Other modifications and ramifications of the present invention would appear to those skilled in the art upon reading the disclosure. These are also intended to be within the scope of this invention.

What is claimed is:

1. A photosensitive member for electrophotographic use having a photosensitive binder layer comprising a. zinc oxide and titanium dioxide photoconductive particles blended in a ratio of about 50:50 to 80:20 by weight and homogeneously dispersed into b. a film forming insulating resin binder, the particles having an average size of about 0.05 micron-to-1.0 micron and the zinc oxide and titanium dioxide particles differing in light sensitivity by a factor of more than about 1.2 based on a gray filtered mean daylight source.

2. The member of claim 1 wherein the weight ratio of photoconductive particles to the insulating resin binder is in the range of about 25:1 to 6:1.

3. The member of claim 1 in which the binder layer is contained on a supporting substrate.

4. The member of claim 1 in which the resin binder includes at least one material selected from the group consisting of copolymers of vinyl chloride and vinyl acetate, thermosetting acrylic resins, epoxy esters of fatty acids of vegetable oils, styrenated alkyl resin and acrylic ester resins.

5. The member of claim 1 in which the titanium dioxide is of the rutile-type.

* * * * *